US006712011B2

(12) United States Patent
Fumanelli

(10) Patent No.: US 6,712,011 B2
(45) Date of Patent: Mar. 30, 2004

(54) ACTIVE-PROTECTION APPARATUS FOR SPRAYING BANKNOTES AND VALUABLES WITH A MARKING FLUID

(75) Inventor: Giuseppe Ezio Fumanelli, Melzo (IT)

(73) Assignee: M.I.B. Elettronica S.r.l., Milan (IT)

( * ) Notice: Subject to any disclaimer, the term of this patent is extended or adjusted under 35 U.S.C. 154(b) by 242 days.

(21) Appl. No.: 09/898,071

(22) Filed: Jul. 5, 2001

(65) Prior Publication Data

US 2003/0005882 A1 Jan. 9, 2003

(51) Int. Cl.[7] ..... E05G 5/00

(52) U.S. Cl. ..... 109/20; 109/29; 109/25; 118/300

(58) Field of Search ..... 109/25, 20, 21, 109/29; 118/300

(56) References Cited

U.S. PATENT DOCUMENTS 5,388,433 A * 2/1995 Andersson et al. ..... 109/29
5,537,938 A * 7/1996 Lopez, Jr. ..... 109/25
5,732,638 A * 3/1998 Van Lint ..... 109/29

* cited by examiner

*Primary Examiner*—Richard Crispino
*Assistant Examiner*—Michelle Acevedo Lazor
(74) *Attorney, Agent, or Firm*—Browdy and Neimark

(57) ABSTRACT

It is disclosed an active-protection apparatus (1) for spraying banknotes and valuables (1*b*) with a marking fluid (1*a*), comprising: a tank (2) for the marking fluid (1*a*), canalizations (4) extending between the tank (2) and the banknotes and valuables (1*b*) to be sprayed, and dispensing means (3) to cause a flow of marking fluid (1*a*) under pressure to be fed into the canalizations (4), the tank (2) being stiff and of a box-shaped configuration and internally having a cavity housing the marking fluid (1*a*), the canalizations (4) and the dispensing means (3), so as to define a spraying unit to be positioned contiguous with the banknotes and valuables (1*b*) to be sprayed, the tank (2) having a bottom wall (8) defining a work surface (8*a*) facing the banknotes and valuables (1*b*) and the canalizations (9) opening at said work surface (8*a*).

15 Claims, 5 Drawing Sheets

ACTIVE-PROTECTION APPARATUS FOR SPRAYING BANKNOTES AND VALUABLES WITH A MARKING FLUID

FIELD OF THE INVENTION

The invention relates to an active-protection apparatus for spraying banknotes and valuables with a marking fluid.

The apparatus can be for example applied to safes and automatic banknote and valuables dispensers generally known as "automatic teller machines" or ATMs and is of the type comprising at least one tank for a marking fluid, canalizations extending between the tank and the banknotes or valuables to be marked and dispensing means to be activated upon command and adapted to cause feeding of a marking-fluid flow through the canalizations.

DESCRIPTION OF THE PRIOR ART

It is known that safes, safe-deposit boxes and cabinets and above all ATMs are often internally provided with active-protection apparatus capable of spraying banknotes and valuables contained therein with a marking fluid in case of effraction attempts.

The marking fluid makes banknotes and valuables unusable and in this way effractions are greatly discouraged. In addition, it is possible to remedy the occurred damages, because the marked banknotes and valuables remained in the ATMs can be recognized and replaced with unmarked ones.

For holding the marking fluid, the apparatus in question comprise tanks generally defined by bottles under pressure placed at the bottom of said ATMs and connected through various pipes and canalizations either to the compartments or drawers or to cases or protected spaces in which banknotes and valuables are kept.

Typically these protected spaces are at a raised position with respect to the bottles and therefore the canalizations extend from the bottom and branch out into different directions so as to reach all points to be protected, all drawers containing banknotes and valuables for example.

Said active-protection apparatus are completed with various dispensing means, valve elements and/or propelling elements for example that, in case of an alarm or access procedures to the banknotes or valuables with non admissible modalities enable or cause discharge of the marking fluid from the tanks and flowing of same along the canalizations, until the banknotes and valuables.

Different electronic and sensor means are provided for control and actuation of said dispensing means.

The active-protection apparatus briefly described above are very satisfactory from an operating point of view, but they have drawbacks of some importance. For instance, disconnecting and reconnecting of the canalizations or pipes of the active-protection apparatus, when the banknote-containing drawers or the like are pulled out for maintenance or supply and then pushed in, are relatively complicated and critical operations.

They greatly slow down the managing operations connected with the ATMs and are also a cause of loss of safety when they are not carried out with the necessary accuracy.

Another drawback is connected with the fact that the active-protection apparatus too must be arranged and housed in a manner adapted not to make them vulnerable. Therefore, there is a need for them to be provided with passive-protection devices avoiding cutting of pipes, breaking of bottles or cutoff of the different connections.

A further drawback of the presently available active-protection apparatus resides in their bulkiness. In fact, as a result of being in search of a minimum outer volume of the ATMs associated with a maximum utilization of the inner space of same, the available space for said apparatus has been reduced to minimum values. In some cases it is possible to arrange them only if a very careful utilization of the inner niches is made.

It should be finally recognized that a basic drawback of the present active-protection apparatus for ATMs is connected with the fact that the same are specifically designed for operating when the banknotes are at the inside of the ATMs themselves.

Therefore the banknotes or valuables in general are not protected during the transportation operations or the displacements carried out for filling or setting up said ATMs.

SUMMARY OF THE INVENTION

Under this situation the technical task underlying the invention is to conceive an active-protection apparatus capable of obviating the mentioned drawbacks. Within the scope of this technical task it is an aim of the invention to devise an active-protection apparatus adapted to be set up in an easy and immediate manner, and that does not need specific passive-protection elements.

It is another aim of the invention to devise an active-protection apparatus to be also used during the operations for transporting or displacing banknotes or valuables and capable of ensuring the greatest operability under any situation. A still further aim of the invention is to devise a versatile apparatus that can be easily adapted to the users' different requirements.

The technical task mentioned and the aims specified are achieved by an active-protection apparatus for spraying banknotes and valuables with a marking fluid, comprising: a tank for the marking fluid, canalizations extending between said tank and the banknotes and valuables to be sprayed, and dispensing means to cause feeding of a flow of marking fluid under pressure along said canalizations, said tank being stiff and of a box-shaped configuration and internally having a cavity housing the marking fluid, at least part of said canalizations and at least part of said dispensing means, so as to define a spraying unit to be positioned contiguous to the banknotes and valuables to be sprayed, said tank having a bottom wall defining a work surface facing the banknotes and valuables and said canalizations opening at said work surface.

BRIEF DESCRIPTION OF THE DRAWINGS

Further features and advantages of the invention will be better clarified in the following detailed description of preferred embodiments of the invention, with reference to the accompanying drawings, in which.

DESCRIPTION OF THE PREFERRED EMBODIMENTS

Figure 2:
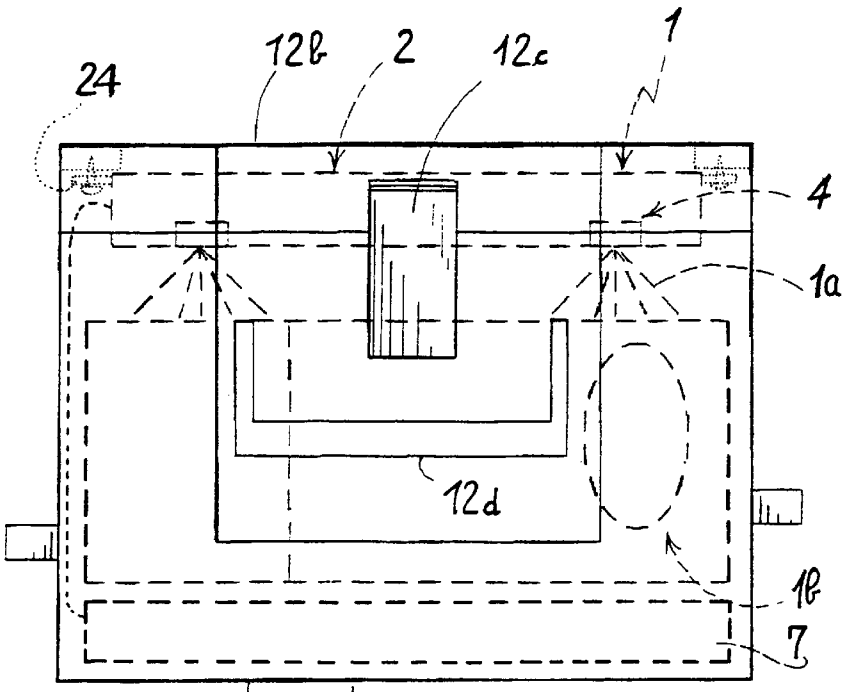
FIG. 2 is a front view, with the inner parts in phantom, of the elements shown in FIG. 1, in a mounted and closed position.

With reference to the drawings, the active-protection apparatus in accordance with the invention is generally identified by reference numeral 1 and the marking or smudging fluid dispensed there from is denoted by 1*a*.

The marking fluid 1*a* is indelible and is a colored or fluorescent liquid for example, with a high penetration capacity, so as to permanently mark and smudge the banknotes or valuables to which it is applied. Shown in FIG. 2 are banknotes 1*b*.

Apparatus 1 comprises at least one tank 2 for the marking fluid 1*a* and dispensing means 3 capable of causing the marking fluid 1*a* to flow upon command and under pressure, out of tank 2, along canalizations 4 extending from tank 2 until the banknotes 1*b* to be marked in an indelible manner.

The dispensing means 3 comprises valve elements 5, to adjust or inhibit the fluid flow 1*a*, and propelling elements 6 to urge the marking-fluid flow 1*a*, upon command, until the banknotes 1*b*.

The dispensing means 3 only intervenes in case of an alarm and in this connection it is to be pointed out that the active-protection apparatus 1 is associated with electronic means 7 comprising programmed electronic circuits, sensors, alarm systems and power supply means, known by themselves.

Figure 1:
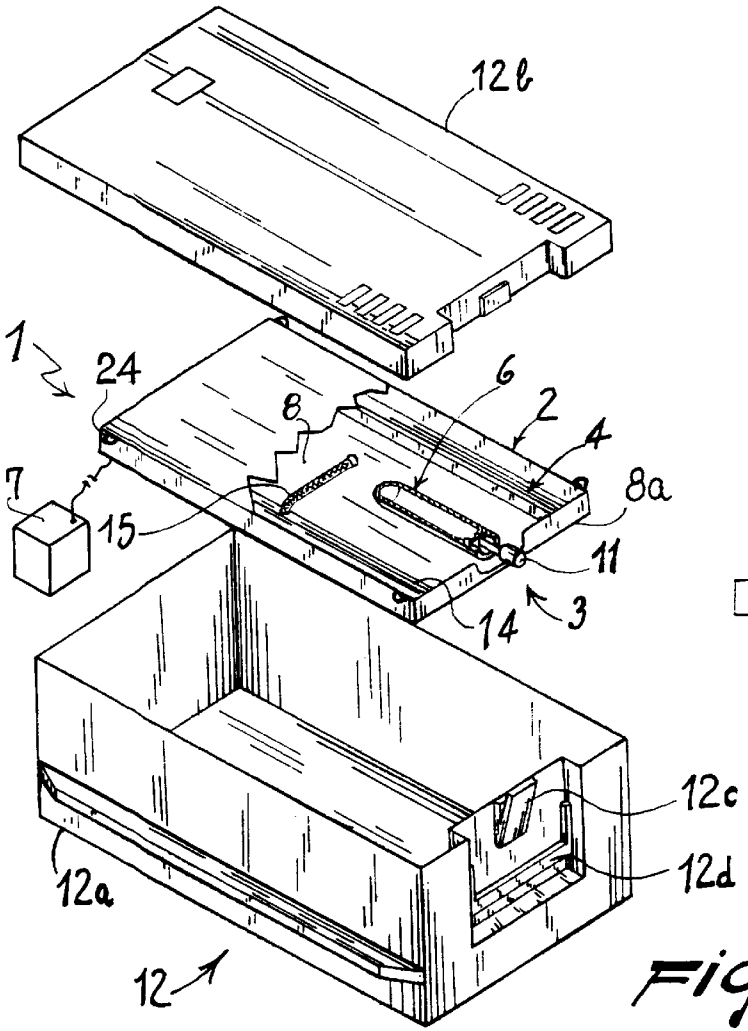
FIG. 1 is an exploded perspective view, partly in split, of an apparatus in accordance with the invention, associated with a drawer for banknotes of the type used in ATMs.
Figure 4:
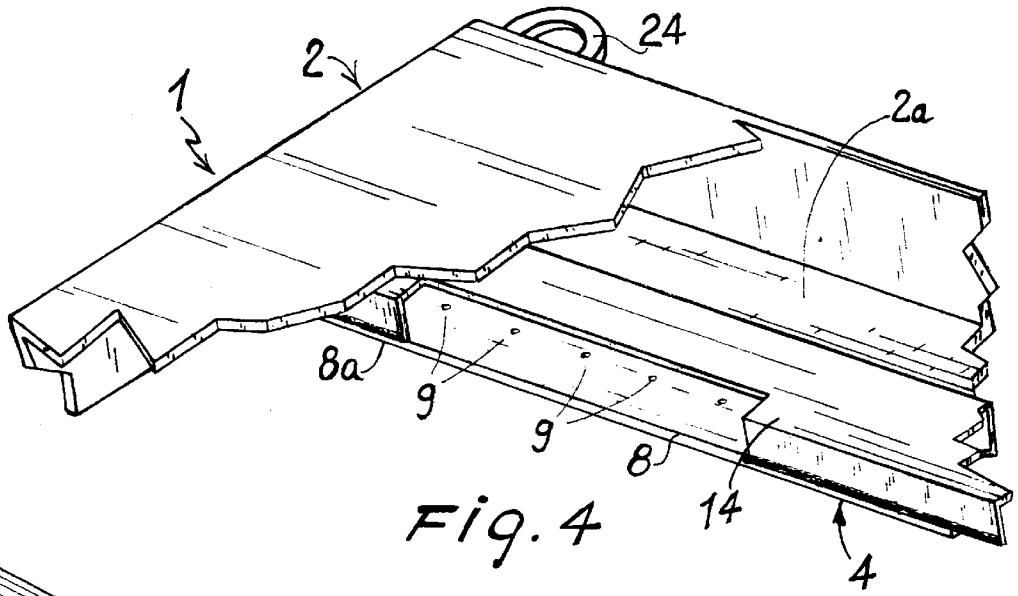
FIG. 4 shows another enlarged portion, in split, of FIG, 1.

The electronic means 7 may be part, for example, of the equipment of an ATM provided with the apparatus 1 or may be associated with apparatus 1. Shown in FIG. 2 is electronic means 7 placed within a casing housing the banknotes 1*b* and under said banknotes, whereas shown in FIG. 1 is electronic means 7 adapted for free placement.

Advantageously, the tank 2, dispensing means 3 and canalizations 4 are joined together to define a compact spraying unit to be positioned in its entirety substantially contiguous with the banknotes 1*b* to be protected.

In this spraying unit, tank 2 embodies the carrying element, which extends in such a manner that it holds and supports the dispensing means 3 and canalizations 4. In fact it is stiff, of a flattened substantially parallelepiped box-shaped configuration and defines the overall outline of the spraying unit.

Formed therein is a cavity in which the marking fluid, dispensing means 3 and canalizations 4 are inserted.

Tank 2 has a bottom wall 8 the lower face of which embodies a work surface 8*a* facing the banknotes 1*b*.

The canalizations 4 are formed at the bottom wall 8 of tank 2 and at their ends comprise diffuser holes 9 defining a plurality of dispensing points for the marking fluid.

To enable arrangement and conservation of a marking fluid 1*a* having components adapted to offer high performance and asking for a separated conservation, the cavity in tank 2 can be divided into a plurality of compartments the contents of which, when dispensed, due to their structure join together and flow into the canalizations 4.

Figure 7:
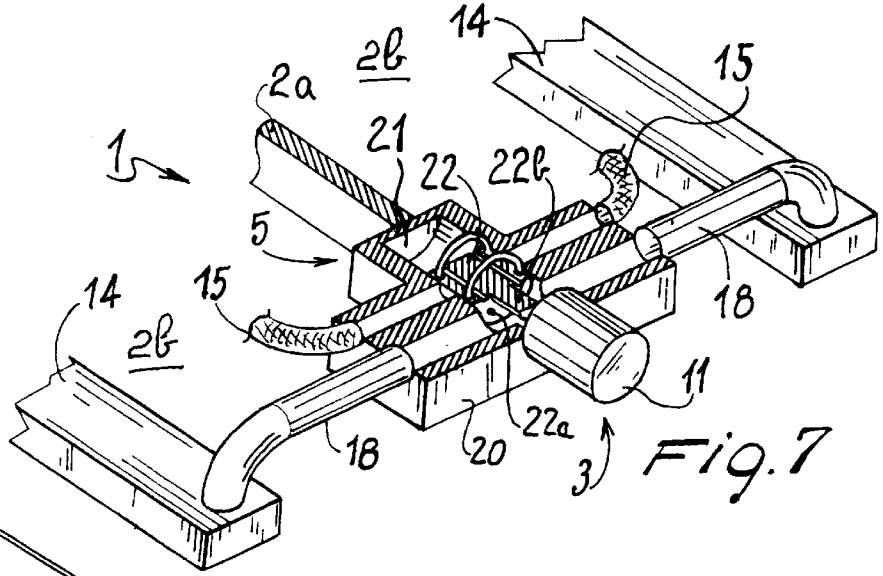
FIG. 7 reproduces some elements of FIG. 6, in a separated position.
Figure 6:
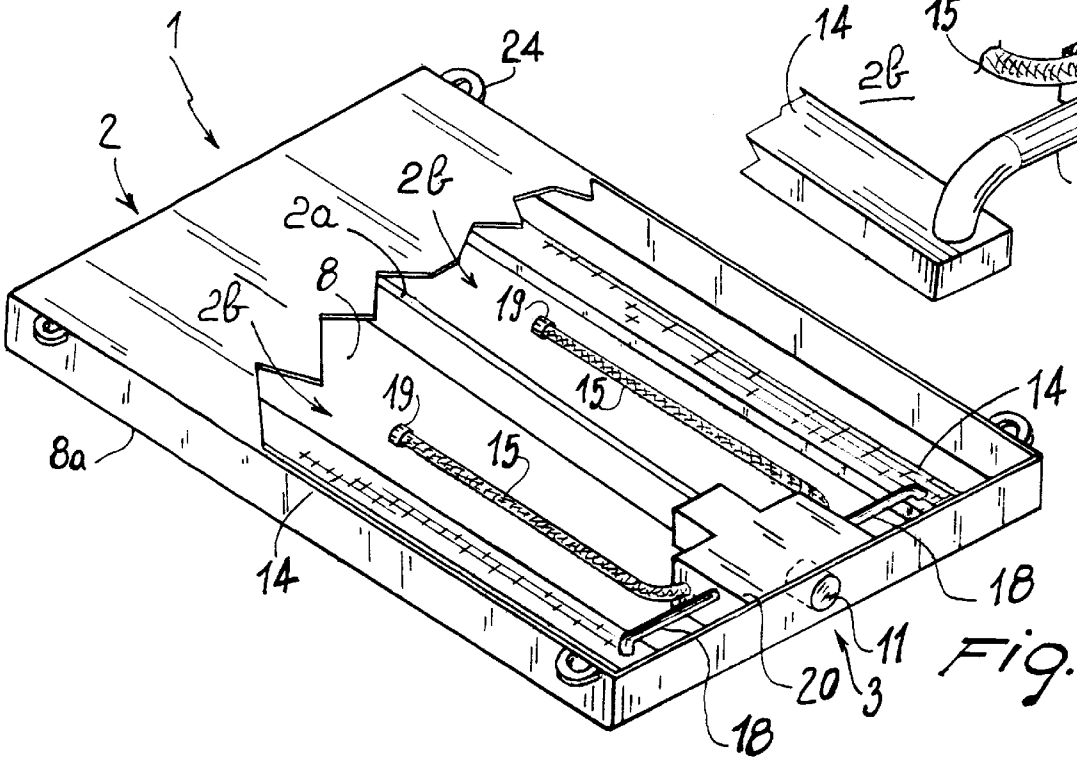
FIG. 6 is a perspective view of another embodiment of the apparatus.
Figure 8:
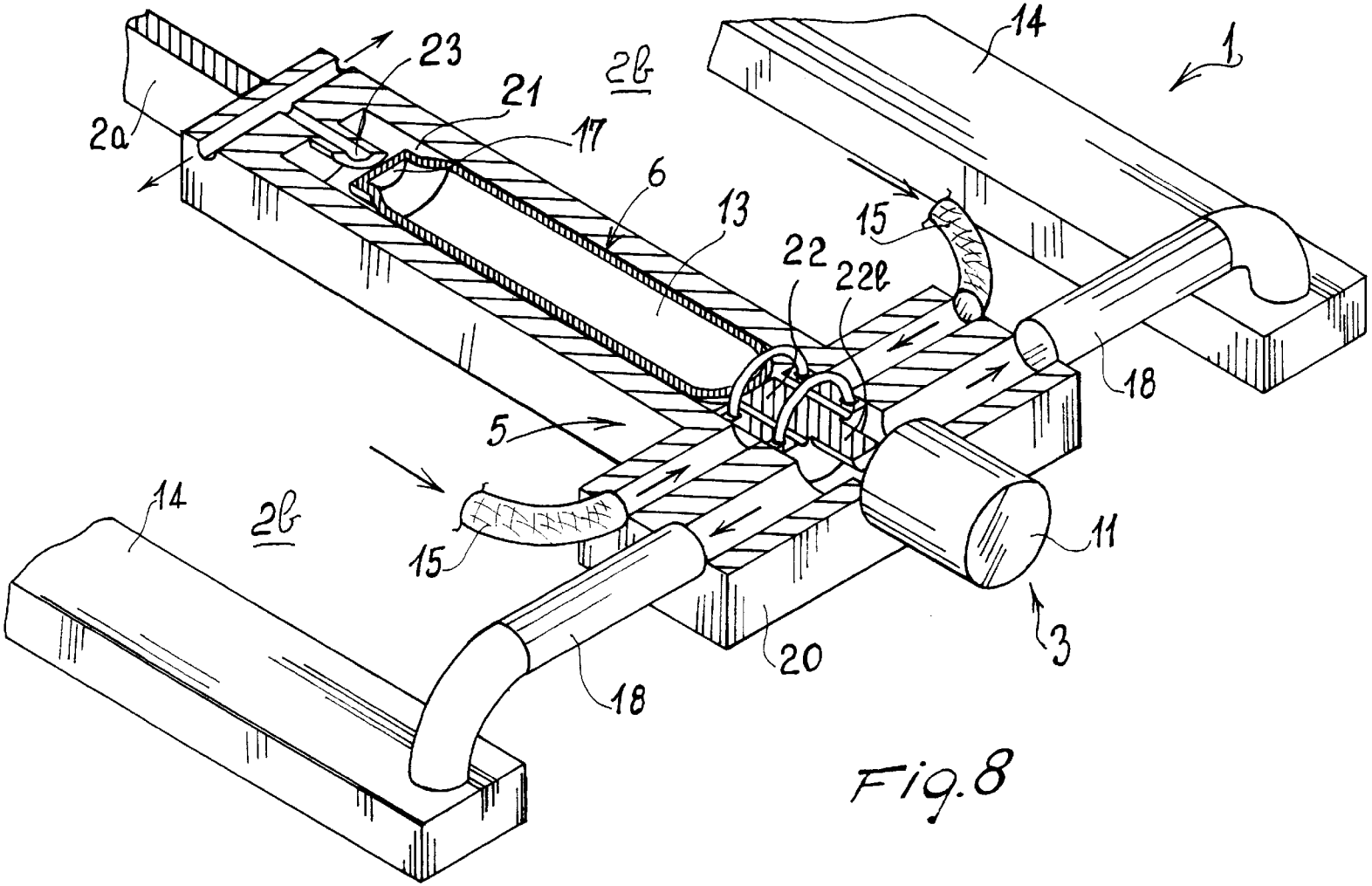
FIG. 8 is an alternative embodiment of FIG. 7.

Said compartments can be disposed in side by side relationship or behind each other and can each hold one or more components of the marking fluid 1*a*. Shown in FIGS. 6, 7 and 8 is a tank 2 the inner cavity of which is divided by a partition 2*a* into two compartments 2*b* disposed in side by side relationship. If the marking fluid 1*a* has its components held in different compartments, it is possible for example to arrange a component such as a catalyst in an isolated condition, in a compartment of its own. By "catalyst" it is intended a reactive component having thermal aims or capable of improving the marking fluid performance.

It is also possible to easily vary the composition of the marking fluid depending on the specific requirements of the safe or the ATM to be protected, or also for the purpose of distinguishing the banknotes from different ATMs, after spraying. In addition, a separate storage is useful for the purpose of reducing aging of the marking fluid 1*a* produced from components having different physical features. Also avoided are deposits and stratifications typical of a fluid made of different components.

The spraying unit forms a covering element for the banknotes 1*b*. In addition, preferably, the spraying unit has the same sizes as a casing or drawer 12 for banknotes 1*b* in an ATM. The casing or drawer 12 comprises a tray 12*a* in which the banknotes 1*b* are disposed, a cover 12*b*, a matching closure element 12*c* and a handle 12*d* for transportation.

The spraying unit or active-protection apparatus 1 can replace cover 12*b* or preferably is placed between the tray 12*a* and cover 12*b* and is made rigid with the latter by means of fastening elements 24, consisting of slots and screws for example.

It is to be pointed out that the canalizations 4 comprise a substantially stiff dispensing duct 14 disposed within the tank 2 and extending close to edges of same. It is mainly made up of U-shaped section members welded to the bottom wall 8 of tank 2 in an inverted position.

The diffuser holes 9 are provided on the portions of the bottom wall 8 cooperating in forming the dispensing duct 14.

Canalizations 4 also comprise at least one flexible hose 15 carrying out the supply of the dispensing duct 14 and provided with a dipping mouth 19 freely movable under gravity within tank 2.

While the dispensing duct 14 performs the function of feeding the diffuser holes 9, the flexible hose 15 has the important task of ensuring that marking fluid and not propelling gas should be fed.

In fact, at the dispensing moment, a pocket of propelling gas can be formed which ejects the marking fluid, usually a liquid of a higher weight than the propelling gas. The liquid spontaneously takes place on the lower part of tank 2 occupying a varying portion depending on the position of the tank itself.

It is in fact necessary to remind that casings or drawers 12 are also submitted to transportation or displacement operations during which the spraying unit in accordance with the invention is still capable of operating. The flexible hose 15, under its own weight, spontaneously takes a position enabling the dipping mouth 19 to be where the marking fluid is, thereby avoiding any drawback.

Shown in FIGS. 1 to 5 is a first preferred embodiment of the active-protection apparatus or spraying unit in accordance with the invention.

In this embodiment the dispensing means 3 comprises valve elements 5 arranged close to the flexible hose 15.

Preferably the valve elements 5 are set exactly at the dipping mouth 19 of the flexible hose 15 and are embodied by a diaphragm 19*a* (FIG. 5) made of plastic material and frangible by pressure.

Figure 3:
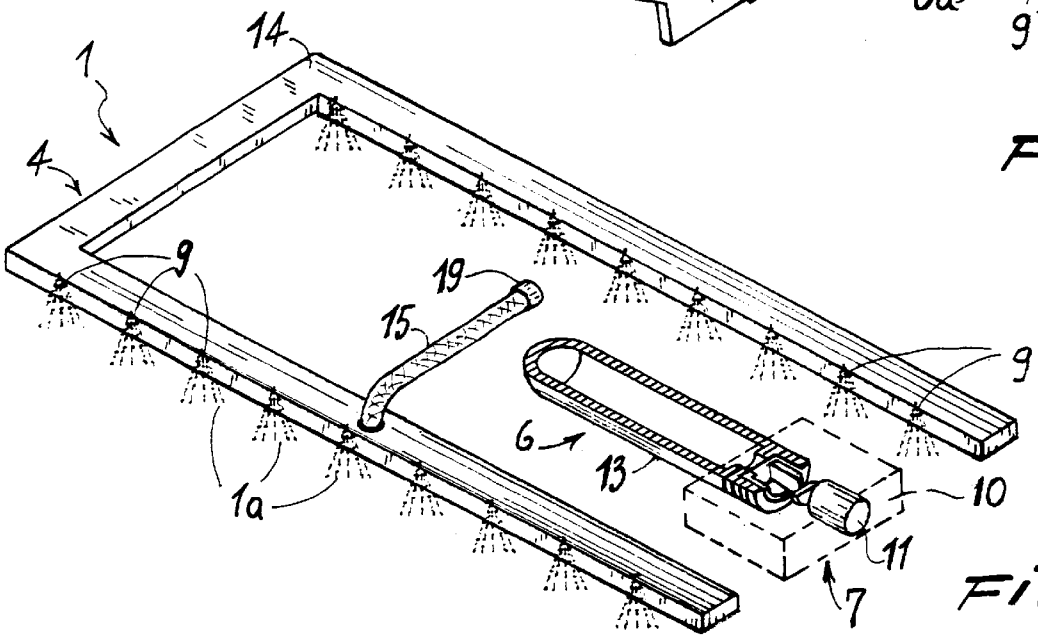
FIG. 3 shows an enlarged portion, in split, of FIG. 1.

The dispensing means 3 further comprises propelling elements 6 and the latter have a bottle 13 of gas under pressure. The bottle 13 is placed within the tank 2 and can be screwed down, through a threading 13*a*, on a support block 10 placed at one end of tank 2 (FIG. 3).

Preferably bottle 13 contains, together with the gas under pressure, an additive of the marking fluid, to be mixed with that in tank 2 but to be conserved separately and capable of giving the fluid better coloring or marking properties, for example. Alternatively said additive may have a composition susceptible of variations so that marked banknotes if removed and found, may indicate their origin with the aid of said additive.

Also provided is an actuator device 11 active on bottle 13 and carried by the support block 10 as well.

The actuator device 11 is selected from electromechanical and pyrotechnic actuators and can be operated by an electric signal from the electronic means 7.

If it is of the electromechanical type, a core or punch controlled in an electromagnetic manner or by a small electric motor is caused to move forward, if it is of the pyrotechnic type a small explosive charge is detonated.

Figure 5:
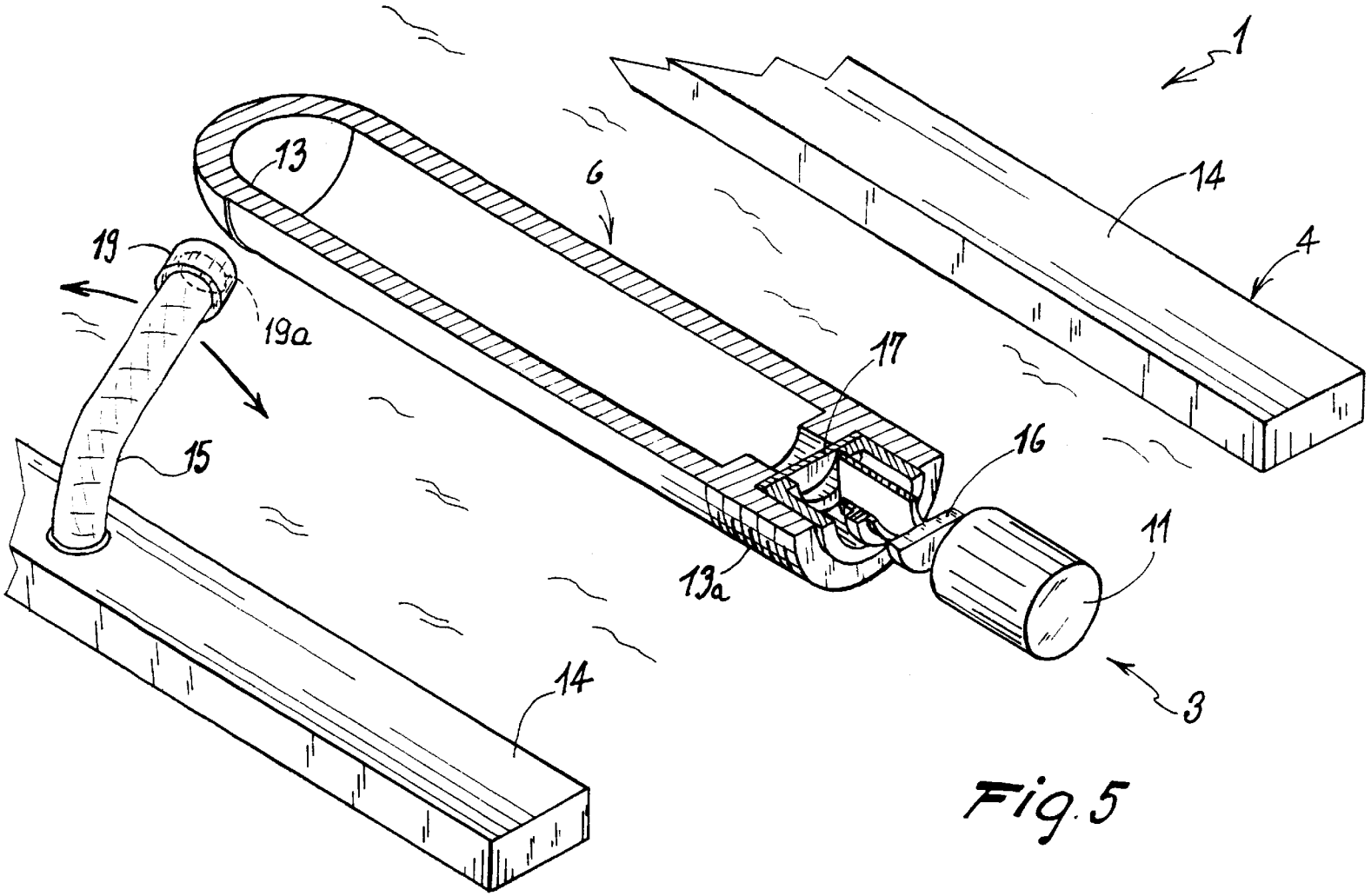
FIG. 5 shows an enlarged detail of FIG. 3.

Preferably the actuator device 11 is of the pyrotechnic type and it acts through a punch element adapted to perforate bottle 13. FIG. 5 the punch element is embodied by a striker 16 placed between the actuator device 11 and bottle 13 and adapted to perforate said bottle at a thinned flat dividing wall 17. The actuator device 11, be it of the electromechanical or pyrotechnic type, can be either mostly disposed within tank 2, inserted in the support block 10 for example, to obtain the greatest protection, or partly placed at the outside of said tank for quick insertion, disconnection or substitution.

FIGS. 6 and 7 show a second embodiment of the invention.

Therein the propelling gas or gas under pressure is already mixed with the marking fluid, within tank 2. Tank 2 is therefore pressurized and preferably divided into two compartments 2*b* by partition 2*a*, to house different components of the marking fluid.

The canalizations 4 comprise a union block 20 interposed between two stiff dispensing ducts 14 having diffuser holes 9 and two flexible hoses 15 provided with dipping mouths 19 movable within tank 2.

The union block 20 internally comprises the valve elements 5 and in addition carries the actuator device 11, active on the valve elements 5.

The union block 20 has a position similar to that of said support block 10 and is provided, in alignment with the actuator device 11, with a guide duct 21.

Opening into the guide duct 21 are the flexible hoses 15 and the dispensing ducts 14, the latter through tailpieces 18.

The valve elements 5 consist of at least one sealing plug element 22 fitted in the guide duct 21 and slidable upon the action of the actuator device 11 between a sealing position (the one shown) and a dispensing position.

Practically, the sealing plug element 22 is caused to move forward until the end of the guide duct 21, so as to bring the flexible hoses 15 and tailpieces 18 into communication with each other, and movement is promoted by small holes 22*a* in the plug 22 enabling air venting. In the figures the sealing plug element 22 has a central body always seen in section, two sealing rings shown not in section and projecting from the central body, and a stem 22*b* of reduced section as compared with the central body and rigidly fixed thereto. Stem 22*b* directly faces the actuator device 11 and enables said device to act immediately on the sealing plug element 22 even if the latter is spaced apart therefrom.

An alternative form of the embodiment shown in FIGS. 6 and 7 is highlighted in FIG. 8. Therein the guide duct 21 extends in length so that it houses a bottle 13 of gas under pressure in the extension of the sealing plug element 22. In addition, the guide duct 21 on the opposite side from its end in engagement with the sealing plug element 22, has a punch element formed of a needle-like small channel 23 facing bottle 13 and capable of perforating it, at said thinned flat dividing wall 17 to cause escape of gas under pressure into tank 2.

Since tank 2 is preferably divided into two compartments 2*b* by partition 2*a*, the needle-like small channel 23 forks, so as to guide supply of gas under pressure towards both said compartments.

Opening of bottle 13 at the needle-like small channel 23 takes place by axial displacement of the bottle caused by displacement of the sealing plug element 22 which therefore also acts as a pusher, upon the action of the actuator mechanism 11.

The advantage of this technical solution consists in the absolute certitude that no accidental escape of marking liquid can occur since tank 2 is not pressurized and in addition it is closed by the sealing plug element 22.

Since tank 2 is not pressurized, the valve elements 5 can comprise not only the sealing plug element 22, but also diaphragms 19*a* made of plastic material and frangible by pressure which are similar to those shown in FIG. 5 and are placed at the dipping mouth 19 of the flexible ducts 15.

Many other advantageous variants of the active-protection apparatus or dispensing unit in accordance with the invention can be envisaged, in addition to those previously described and illustrated.

For instance, the guide duct 21 can be prolonged in length to a greater extent than shown in FIG. 8 and can be such structured that it too forms a dispensing duct 14, in addition to the other dispensing ducts 14. For the purpose, the elongated guide duct 21 is devoid of bottle 13 and of the needle-like small channel 23 and has side passageways for insertion thereinto of the marking fluid present in compartments 2*b*, and diffuser holes 9 facing downwardly for supplying the marking fluid from said passageways to the banknotes 1*b*. To prevent fluid dispensing from taking place in the absence of a specific command, in the elongated duct 21 provision may be made for a plurality of sealing plug elements 22 linked with each other and sliding all together—upon the action of the actuator device 11—from a first rest position to a second more forward dispensing position.

In the first rest position the sealing plug elements 22 close the side passageways and the underlying diffuser holes 9.

On the contrary, in the second dispensing position obtained upon the thrust action of the actuator device 11 moving the whole series of plug elements 22, the side passageways and diffuser holes 9 are placed close to stems 22*b* that, for their smaller section, enable flow of the marking fluid. Obviously the positions of the side passageways and diffuser holes 9 must be correlated with the positions and sizes of the plug elements 22 and stems 22*b* thereof.

The elongated guide duct 21 structured as above illustrated, may also embody the only dispensing duct 14, in the middle of tank 2.

Then it is also possible to provide for canalizations 4 only embodied by the diffuser holes 9 on the bottom wall 8 of tank 2 and for valve elements 5 defined by a sealing plate laid down on the bottom wall 8 and having through openings to be brought into alignment, upon command, with the diffuser holes 9. The sealing plate can be movable upon the action of the actuator device 11 so as to obtain said alignment between the through openings and diffuser holes 9.

The invention achieves important advantages.

The spraying unit in accordance with the invention incorporates in a reduced volume, all elements necessary for an efficient active protection of banknotes and valuables and can be disposed substantially in contact with the same. In particular, the unit can be directly fitted in casings or drawers holding the banknotes and valuables. Under this situation, if provided with independent power supply and independent electronic and sensor means, the unit can also act when the casings or drawers are submitted to forcing while they are transported or moved.

Once it is inserted in the casings, the unit does not need specific passive-protection elements since it enjoys the same passive-protection level as the banknotes to be protected.

In addition it has a quite negligible bulkiness and safes or ATMs can be planned and manufactured without providing specific spaces for an active-protection apparatus.

The spraying unit has a very versatile structure, because it can be made in a great variety of embodiments that are advantageous under different aspects. For instance, arrangement of several compartments at the tank and division of the marking fluid into its different components are advantageous features. Furthermore, due to the presence of the flexible hoses, it is possible to ensure in a simple and safe manner that the marking liquid and not the propelling gas should be always dispensed.

What is claimed is:

1. An active-protection apparatus for spraying banknotes and valuables with a marking fluid, comprising:

a tank for the marking fluid, canalizations extending between said tank and the banknotes and valuables to be sprayed, and dispensing means to cause a flow of marking fluid under pressure to be fed along said canalizations, said tank being stiff and of a box-shaped configuration and internally having a cavity housing the marking fluid, said cavity further housing at least part of said canalizations and at least part of said dispensing means, whereby said tank defines a spraying unit to be positioned contiguous to the banknotes and valuables to be sprayed, said tank having a bottom wall defining a work surface facing the banknotes and valuables and said canalizations opening at said work surface.

2. The apparatus as claimed in claim 1, comprising at least one casing for housing said banknotes and valuables, wherein said casing has a cover and said tank is fitted between said banknotes and said cover, and wherein said box-shaped tank substantially defines an overall outline of said spraying unit.

3. An active-protection apparatus for spraying banknotes and valuables with a marking fluid, comprising:

a tank for the marking fluid, canalizations extending between said tank and the banknotes and valuables to be sprayed, and dispensing means to cause a flow of marking fluid under pressure to be fed along said canalizations, said tank being stiff and of a box-shaped configuration and internally having a cavity housing the marking fluid, at least part of said canalizations and at least part of said dispensing means, so as to define a spraying unit to be positioned contiguous to the banknotes and valuables to be sprayed, said tank having a bottom wall defining a work surface facing the banknotes and valuables and said canalizations opening at said work surface, wherein said canalizations comprise at least one flexible hose placed in said tank and provided at the end with a dipping mouth movable under gravity within said tank.

4. The apparatus as claimed in claim 3, wherein said dispensing means comprises at least one bottle of gas under pressure placed within said tank, and valve elements adapted to control the marking-fluid flow and including a diaphragm made of plastic material and frangible by pressure, said diaphragm being disposed at said dipping mouth.

5. The apparatus as claimed in claim 3, wherein said canalizations comprise, downstream of said at least one flexible hose, at least one stiff dispensing duct inserted in said cavity and made rigid and contiguous with said bottom wall, and a plurality of diffuser holes formed in said bottom wall and defining a plurality of dispensing points for the marking fluid.

6. The apparatus as claimed in claim 5, wherein said dispensing means comprises valve elements adapted to control the marking-fluid flow and including a sealing element movable upon command and arranged in said tank at an intermediate position between said at least one flexible hose and said at least one stiff dispensing duct.

7. An active-protection apparatus for spraying banknotes and valuables with a marking fluid, comprising:

a tank for the marking fluid, canalizations extending between said tank and the banknotes and valuables to be sprayed, and dispensing means to cause a flow of marking fluid under pressure to be fed along said canalizations, said tank being stiff and of a box-shaped configuration and internally having a cavity housing the marking fluid, at least part of said canalizations and at least part of said dispensing means, so as to define a spraying unit to be positioned contiguous to the banknotes and valuables to be sprayed, said tank having a bottom wall defining a work surface facing the banknotes and valuables and said canalizations opening at said work surface, wherein said tank internally comprises at least one bottle adapted to dispense gas under pressure, upon command, in said cavity and wherein said at least one bottle internally includes at least one additive for the marking fluid housed in said cavity.

8. An active-protection apparatus for spraying banknotes and valuables with a marking fluid comprising:

a tank for the marking fluid, canalizations extending between said tank and the banknotes and valuables to be sprayed, and dispensing means to cause a flow of marking fluid under pressure to be fed along said canalizations, said tank being stiff and of a box-shaped configuration and internally having a cavity housing the marking fluid, at least part of said canalizations and at least part of said dispensing means, so as to define a spraying unit to be positioned contiguous to the banknotes and valuables to be sprayed, said tank having a bottom wall defining a work surface facing the banknotes and valuables and said canalizations opening at said work surface, wherein said cavity comprises a plurality of compartments, wherein said canalizations are in communication with said compartments, and wherein said marking fluid comprises a plurality of components selectively distributed in said compartments to enable arrangement and conservation of the marking fluid having components requiring a separated conservation.

9. An active-protection apparatus for spraying banknotes and valuables with a marking fluid, comprising:

a tank for the marking fluid, canalizations extending between said tank and the banknotes and valuables to be sprayed, and dispensing means to cause a flow of marking fluid under pressure to be fed along said canalizations, said tank being stiff and of a box-shaped configuration and internally having a cavity housing the marking fluid, at least part of said canalizations and at least part of said dispensing means, so as to define a spraying unit to be positioned contiguous to the banknotes and valuables to be sprayed, said tank having a bottom wall defining a work surface facing the banknotes and valuables and said canalizations opening at said work surface, wherein said dispensing means comprises a bottle of gas under pressure; a punch element adapted to perforate said bottle and an actuator device adapted to cause a relative movement between said punch element and said bottle to perforate said bottle.

10. The apparatus as claimed in claim 9, wherein said punch element is a striker fitted between said actuator device and said bottle.

11. The apparatus as claimed in claim 9, wherein said actuator device is selected from electromechanical and pyrotechnic types, electronic means being provided for controlling said actuator device.

12. An active-protection apparatus for spraying banknotes and valuables with a marking fluid comprising:

a tank for the marking fluid, canalizations extending between said tank and the banknotes and valuables to be sprayed, and dispensing means to cause a flow of marking fluid under pressure to be fed along said canalizations, said tank being stiff and of a box-shape configuration and internally having a cavity housing the marking fluid, at least part of said canalizations and at least part of said dispensing means, so as to define a spraying unit to be positioned contiguous to the banknotes and valuables to be sprayed, said tank having a bottom wall defining a work surface facing the banknotes and valuables and said canalizations opening at said work surface, wherein said dispensing means comprises valve elements arranged within said tank, at said canalizations, and an actuator device adapted to drivingly cause translation of said valve elements.

13. The apparatus as claimed in claim 12, wherein said valve elements comprise at least one sealing plug element which is, upon command, axially movable between a sealing position and a dispensing position.

14. The apparatus as claimed in claim 12, further comprising a punch element and a bottle for gas under pressure, wherein said actuator device is adapted both to drivingly cause translation of said valve elements and to cause a relative movement between said punch element and said bottle, in order to perforate said bottle.

15. The apparatus as claimed in claim 14, wherein said actuator device, valve elements, bottle and punch element are disposed consecutively in alignment with each other.

* * * * *